US006115936A

United States Patent [19]

Arlie

[11] Patent Number: 6,115,936

[45] Date of Patent: Sep. 12, 2000

[54] FREE TUMBLING PADDED SHOE CONTAINER FOR USE IN CLOTHES DRYER

[76] Inventor: Daniel Arlie, 2844 Waverley St., Palo Alto, Calif. 94306

[21] Appl. No.: 09/374,925

[22] Filed: Aug. 16, 1999

[51] Int. Cl.[7] ..... F26B 19/00

[52] U.S. Cl. ..... 34/61; 34/106; 34/109; 34/600

[58] Field of Search ..... 34/60, 61, 90, 34/106, 109, 600, 604; 15/3, 210.1, 90, 97.1; 68/143, 235 R

[56] References Cited

U.S. PATENT DOCUMENTS

| | | | |
|---|---|---|---|
| 4,091,548 | 5/1978 | Daily | 34/202 X |
| 4,109,397 | 8/1978 | Daily | 34/239 |
| 4,617,743 | 10/1986 | Barnard | 34/109 |
| 4,691,400 | 9/1987 | Arneson | 15/3 |
| 4,800,605 | 1/1989 | Arneson | 15/3 |
| 5,123,967 | 6/1992 | Arneson | 134/6 |
| 5,276,979 | 1/1994 | Gordon, Sr. | 34/109 X |
| 5,743,025 | 4/1998 | Jordan, Jr. | 34/600 |

*Primary Examiner*—Stephen Gravini

[57] ABSTRACT

The device consisting of a hollow body made of foam rubber or other shock absorbing material defining an enclosed chamber and having a plurality of holes therein. A closeable opening is provided that is of adequate size to allow wet tennis shoes or other objects in need of drying to be placed inside said enclosed chamber. The unit with the articles to be dried within are inserted into a rotary drum clothes dryer and the loud thumping and banging noise normally associated with drying heavy shoes in a rotating metal drum are significantly reduced or eliminated. Further, the padding and shock absorbing shape of the envelope prevents the dryer's door from being knocked open from the inside as often happens when hard shoes hit the back of the door during the tumbling and drying process. Furthermore, shoes and delicate fabrics may safely be dried in the same load as they are effectively separated by the device.

1 Claim, 7 Drawing Sheets

FREE TUMBLING PADDED SHOE CONTAINER FOR USE IN CLOTHES DRYER

BACKGROUND-FIELD OF THE INVENTION

The present invention relates to footwear drying devices, specifically a novel and useful design for a padded shoe container which can be inserted and removed from a rotary type clothes dryer.

BACKGROUND-DESCRIPTION OF PRIOR ART

Problems have arisen in using rotary type clothes dryers to dry footwear, such as tennis shoes, that the present invention solves in a novel manner. The loud thumping and banging noises normally generated by placing relatively hard footwear in the rotating metal drum of a clothes dryer designed primarily to tumble soft clothes is abated to a significant degree by the padding and sound deadening effect afforded by the free tumbling padded shoe container described herein. Additionally, the problem of shoes bouncing against the inside of the door to the dryer and knocking it open is eliminated as the cushioning deadens any impact the container may have with the door to such a degree that insufficient impact force is generated to knock the door open. Furthermore, delicate fabrics can be placed in the dryer at the same time without being damaged or tangled up with the shoes as the shoes and these other articles are effectively kept separated.

No other device has been shown that will solve these problems in the manner and by the method shown. Prior art attempting to solve the problems described show various compartments or other securing means that attach the items to the interior of the dryer thusly preventing tumbling altogether. However, containers attached to the drum pose the possibility of coming loose and pose the inconvenience of having to be installed and removed. Additionally, any device which holds the shoes closely to the side of the dryer substantially removes the articles from the main flow of hot, drying air, reducing efficiency of the drying. The drying efficacy is further reduced in these devices by the elimination of the tumbling action which allows the full exterior of the shoes to be substantially in contact with the drying air at all times without resultant wet spots where the shoe may remain in contact with the sides of the container or the other shoe. Devices attached to the dryer's drum may also throw it off balance and damage to the dryer could result.

My invention is the only one that allows the shoes to tumble freely in a padded container such that any noise or other problems previously associated with this process are eliminated.

It is apparent that a novel and useful padded free tumbling shoe container for use in a clothes dryer is not shown in the prior art provided.

OBJECTS AND ADVANTAGES

Accordingly, besides the objects and advantages of the free tumbling padded shoe container for use in clothes dryers described in my above patent, several objects and advantages of the present invention are:

a) to provide a shoe container which encapsulates and cushions shoes to allow them to be noiselessly and effectively dried in a rotary type clothes dryer.

b) to provide a cushioned, shock absorbing container that will soften the impact of tumbling shoes when they come in contact with the inside of the loading door of a clothes dryer such that the door will not be knocked open.

c) to provide a container which keeps shoes in a clothes dryer separate from any more delicate articles of clothing therefore preventing their entanglement and damage.

d) to provide a shoe container that can be easily placed in and removed from a clothes dryer without the necessity of it being in any way attached or secured to any part of the dryer.

DESCRIPTION OF THE PREFERRED EMBODIMENTS

The following embodiments of the present invention should be understood and interpreted in accordance with the heretofore described drawings.

Figure 1:
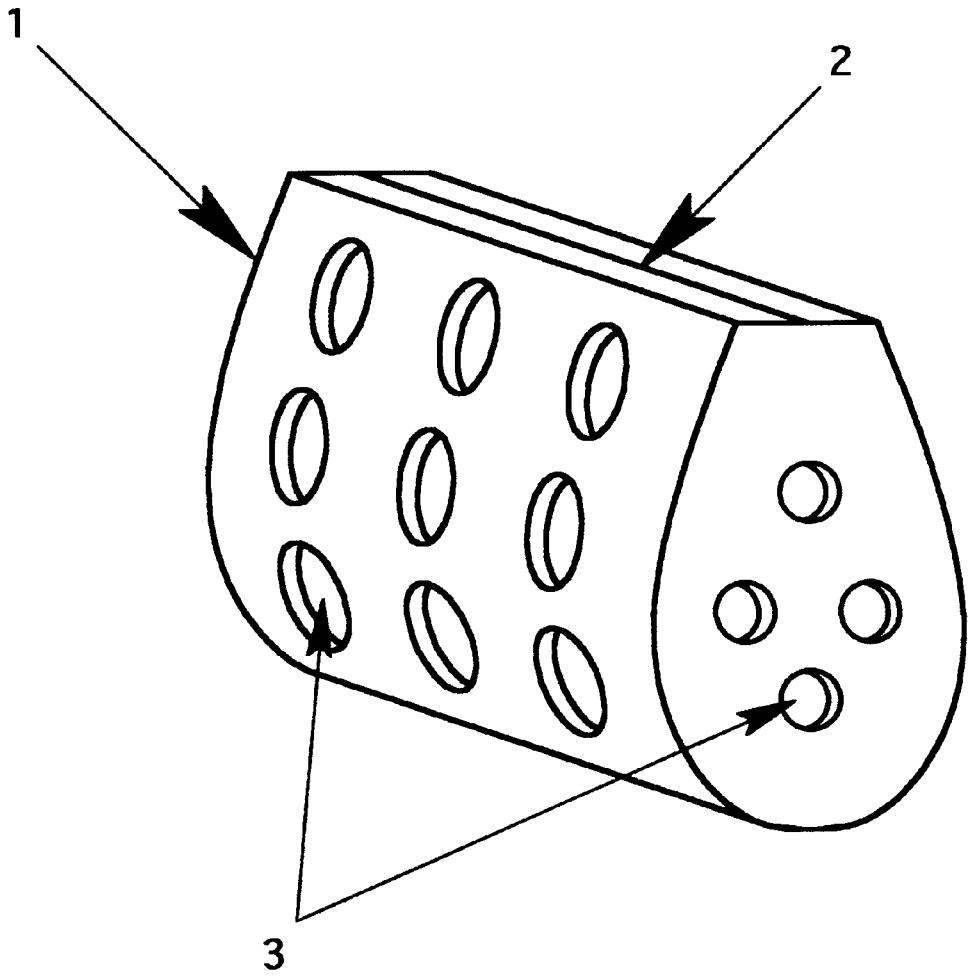
FIG. 1 is a drawing depicting an isometric view of the preferred embodiment of the present invention.
Figure 2:
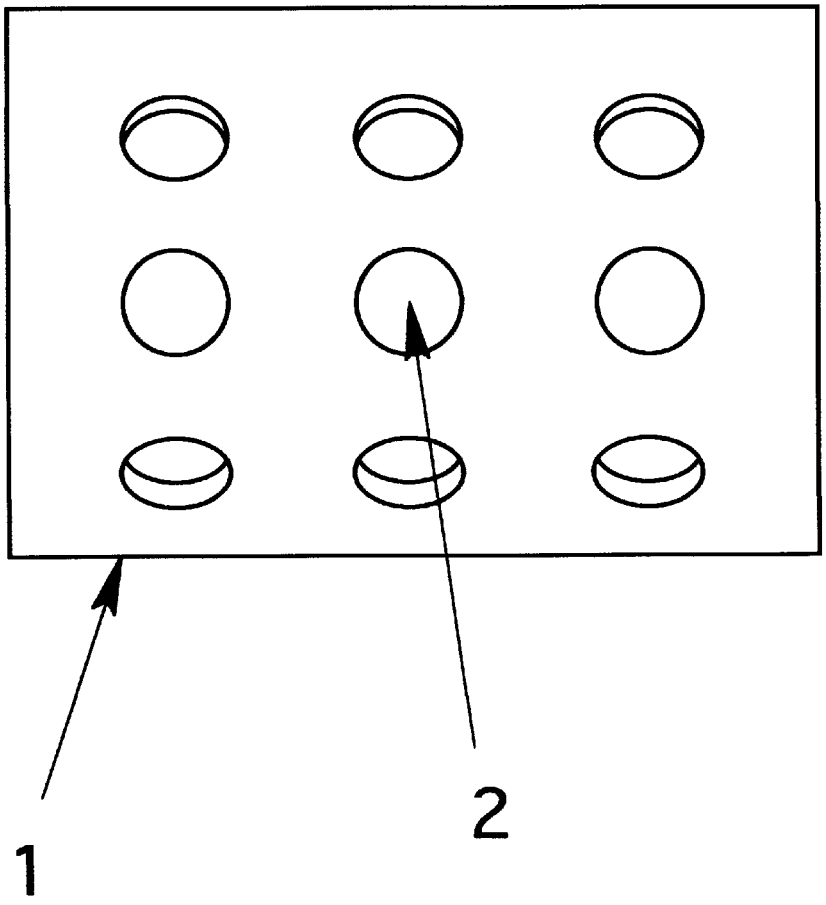
FIG. 2 is side elevation thereof.
Figure 3:
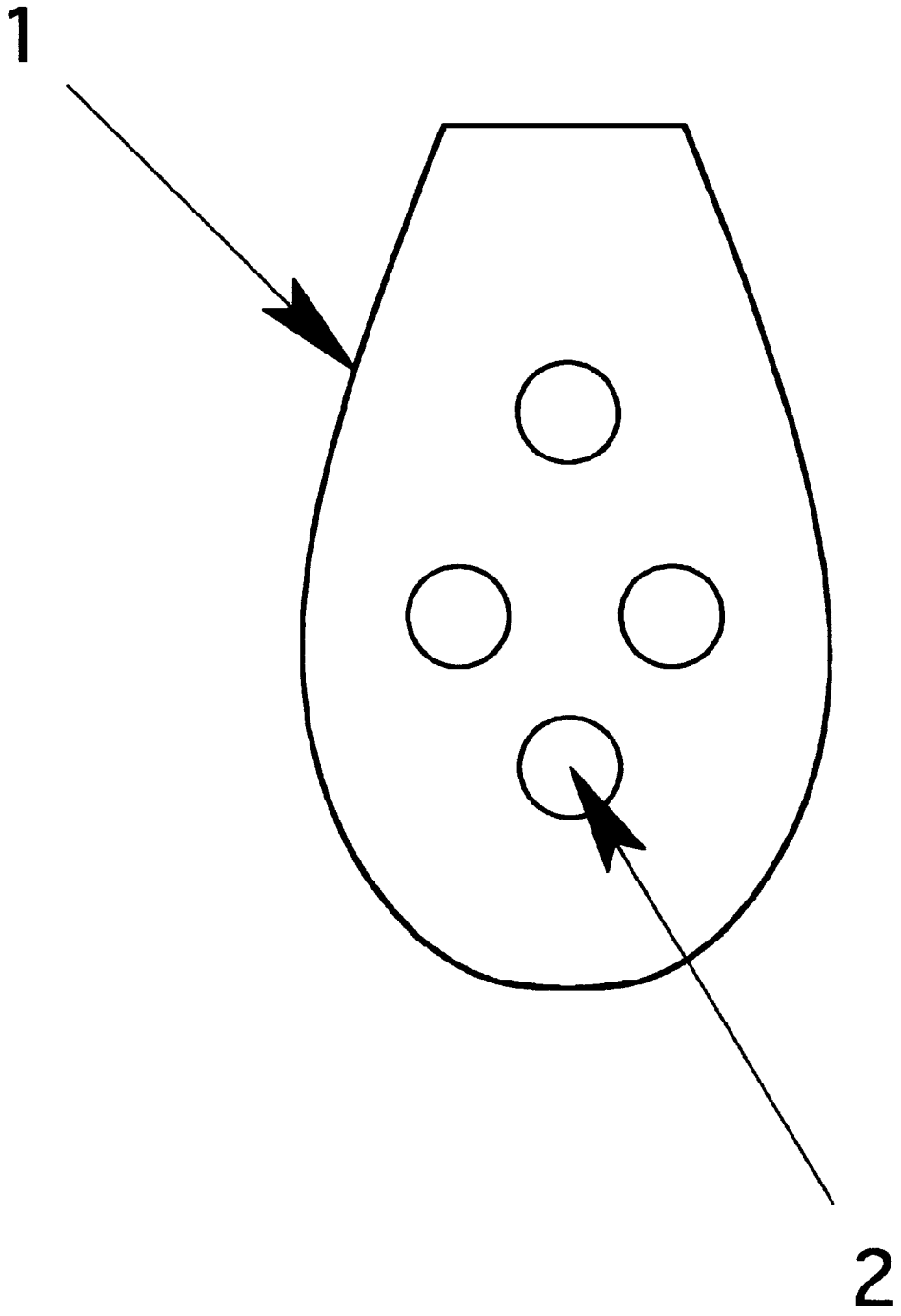
FIG. 3 is an end elevation thereof.
Figure 4:
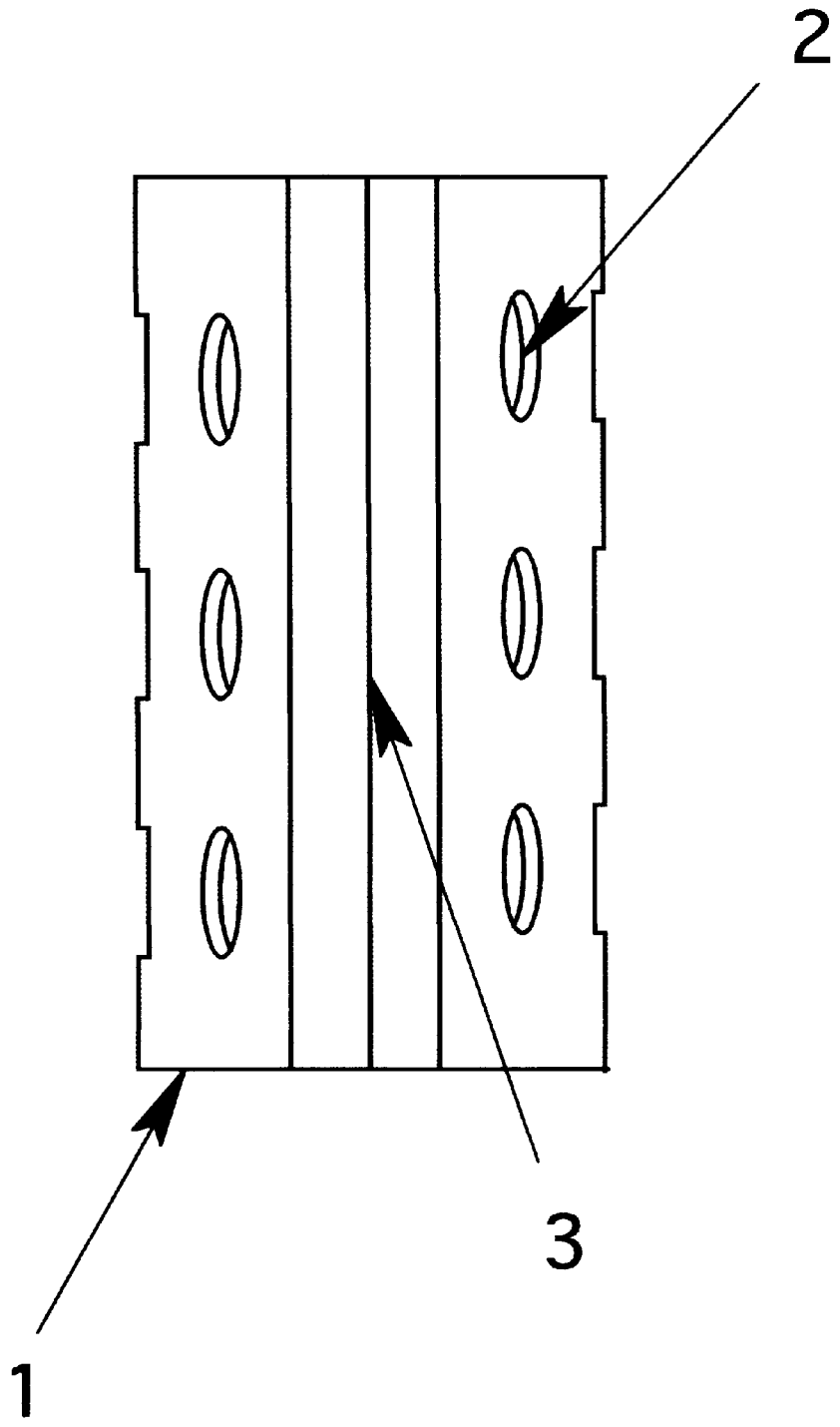
FIG. 4 is a top view thereof.
Figure 5:
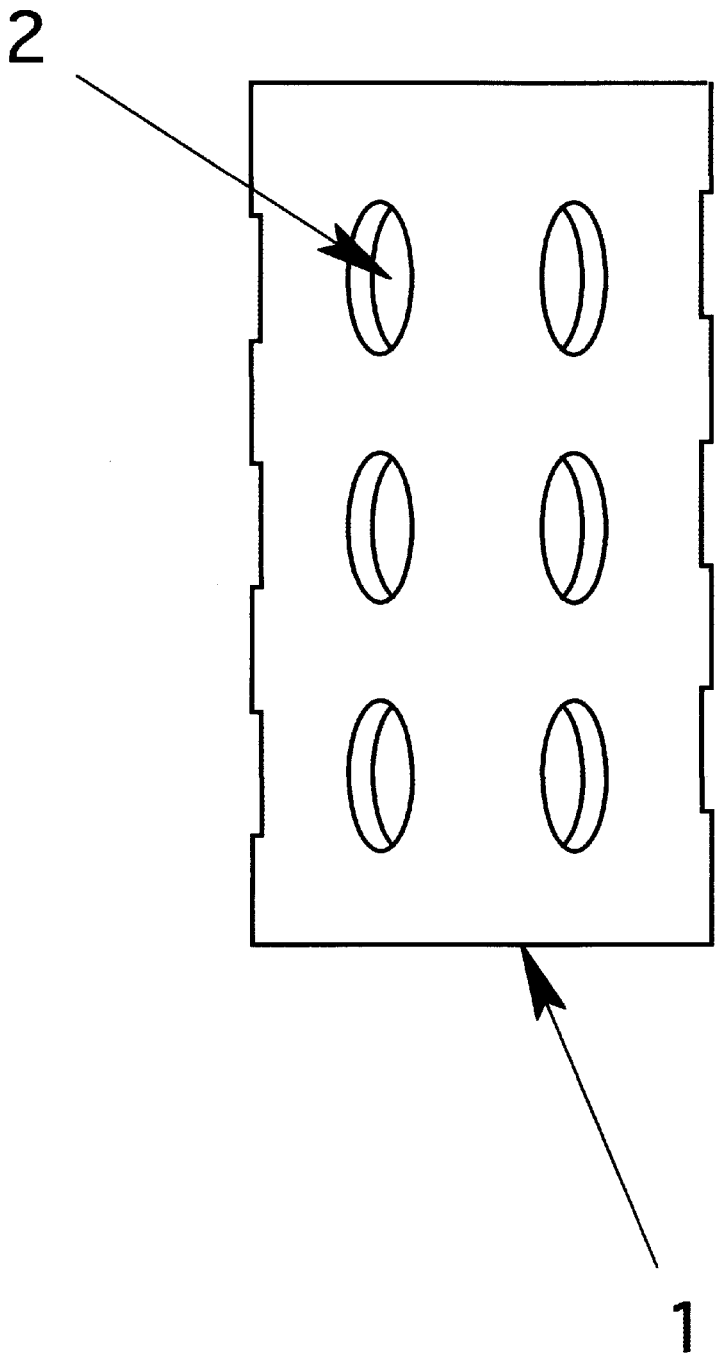
FIG. 5 is a bottom view thereof.

The invention as a whole is depicted by reference FIG. 1 which would be the complete padded shoe container for use in a clothes dryer and includes characters 1 - padded envelope, 2 - securable envelope opening, 3 - ventilation holes.

An envelope (1) made of soft pliant material such as foam rubber or similar material and which can be opened at one end (2) to allow shoes to be inserted therein. The opening which may be secured by any of the following means, a zipper running the length of the opening, velcro strips attached to either side of the opening or snap style fasteners or buttons, or use of an opening of sufficient stiffness that it will spring shut after shoes are inserted therein, keeping the shoes inside the envelope during the drying process. Shoes may be placed in the envelope after washing and the envelope containing the wet shoes are inserted into the dryer which is turned on. A plurality of ventilation holes (3) perforates all surfaces of the envelope and allows the hot air of the dryer to pass through to the shoes effecting their efficient drying. The padded envelope (1) absorbs the shock caused by the shoes tumbling and hitting the interior of the dryer reducing any resultant noise and preventing the dryer door from being knocked open from the inside.

OPERATION FIG. 6

Figure 6:
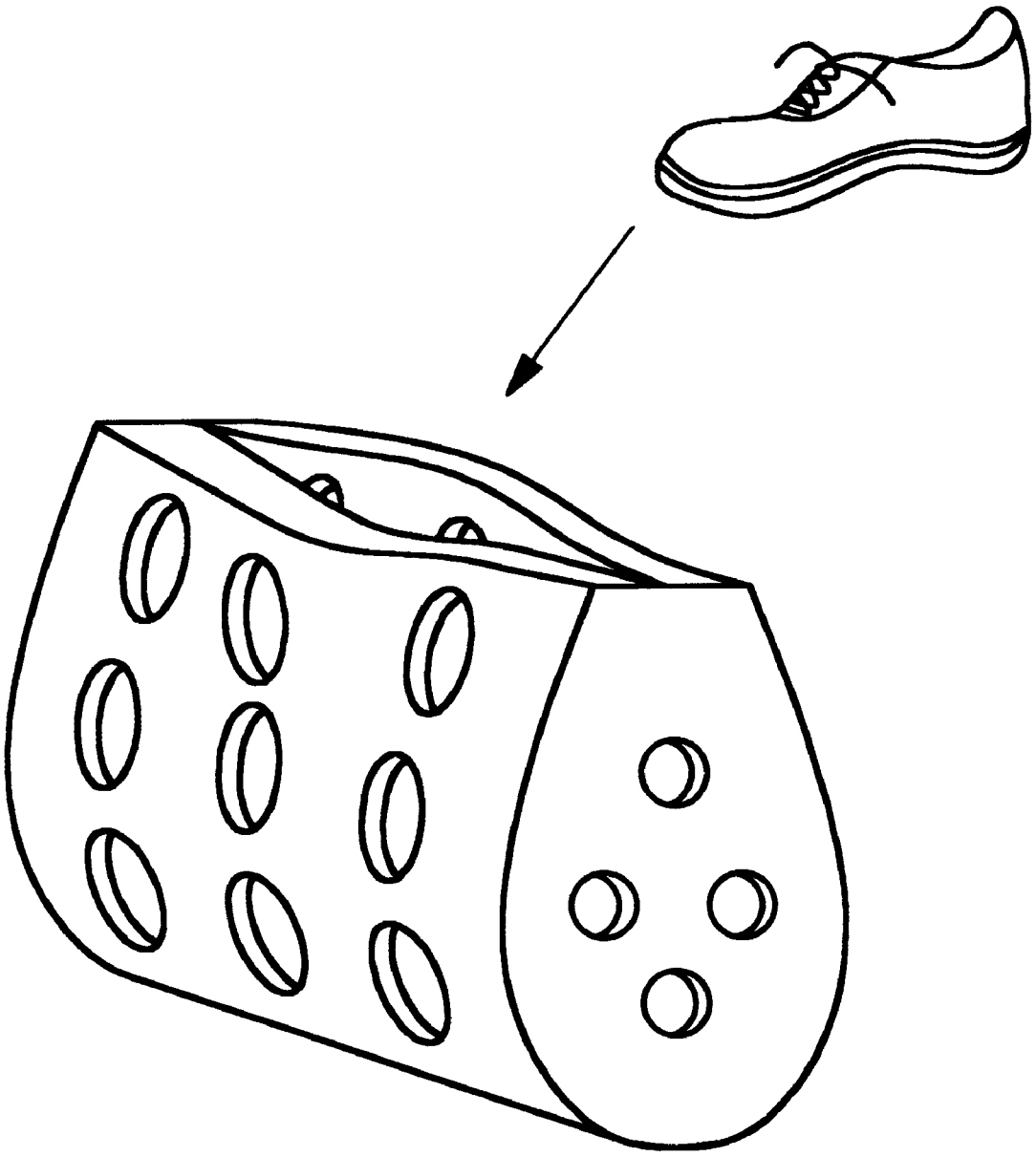
FIG. 6 is a drawing showing the opening and use thereof.
Figure 7:
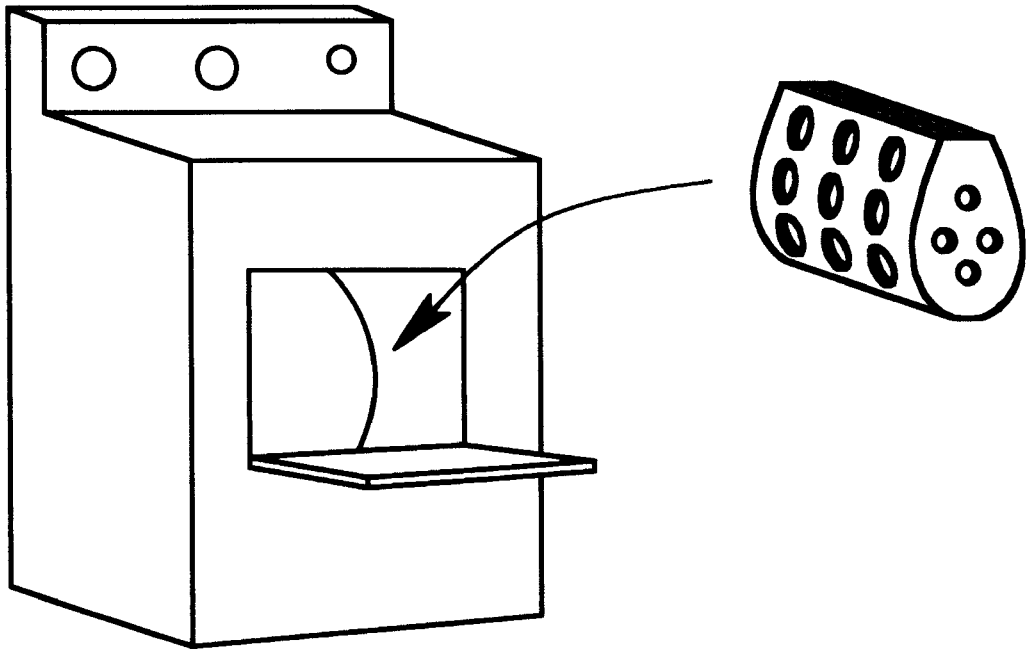
FIG. 7 is a drawing showing the insertion of the unit into a clothes dryer.

FIG. 6 shows the container in it's opened position showing how shoes would be inserted before being placed in a clothes dryer. FIG. 7 shows the unit being placed in a rotary type clothes dryer.

SUMMARY OF THE INVENTION

In accordance with the present invention a novel and useful footwear container which allows shoes to be dried quietly and effectively in a rotary type clothes dryer is provided.

Clothes dryers which utilize a rotating drum to tumble the clothes during the drying process are problematic when applied to the drying of shoes owing to the noise created when the hard shoes hit the metal or hard plastic drum during the tumbling process. They may also be thrown into the back of the loading door, knocking it open and stopping the dryer. The heavy tumbling shoes may also become entangled with more delicate articles of clothing causing them to be damaged. These problems can be largely eliminated with the present invention.

Although the above description and drawings contains many specificities, these should not be construed as limiting the scope of the invention but as merely providing illustrations of some of the presently preferred embodiments of this invention. For example, the enclosure can have other shapes, such as that of a ball, icosahedron or box, etc.; the opening into which the shoes are inserted can be shaped or configured differently; the slot can be replaced by a hinged section which opens allowing placement and removal of the shoes, etc. The round air holes shown may be replaced by any shape, density or arrangement of perforations or by constructing the device with a material which is porus enough to allow a free flow of air through the walls of the device, etc.

Thus the scope of the invention should be determined by the appended claims and their legal equivalents, rather than by the examples given.

What is claimed:

1. A padded footwear container for insertion into a rotary type clothes dryer comprising:

a padded free tumbling shoe container further comprising:

a padded envelope made of soft pliant material providing cushioned shock absorption to soften the impact of shoes contacting an internal drum and door of said clothes dryer;

a securable envelope opening to keep shoes inside said envelope during the drying process;

ventilation holes perforating all surfaces of said envelope and allowing hot air of said clothes dryer to pass through shoes for drying;

said padded free tumbling shoe container can be inserted and removed from said clothes dryer without being attached or secured to said dryer.

* * * * *